US007402046B1

(12) United States Patent
Zhang

(10) Patent No.: US 7,402,046 B1
(45) Date of Patent: Jul. 22, 2008

(54) POWER SUPPLY TERMINAL

(75) Inventor: Wei-Yang Zhang, Kln. Bay (CN)

(73) Assignee: NCW Holdings Limited, Hong Kong (CN)

( * ) Notice: Subject to any disclaimer, the term of this patent is extended or adjusted under 35 U.S.C. 154(b) by 0 days.

(21) Appl. No.: 11/893,321

(22) Filed: Aug. 15, 2007

(30) Foreign Application Priority Data

May 21, 2007 (CN) ..... 2007 1 0107540

(51) Int. Cl.
*H01R 29/00* (2006.01)

(52) U.S. Cl. ..... 439/49; 439/713; 439/798

(58) Field of Classification Search ..... 439/49, 439/53, 214, 215, 713, 721, 798, 801
See application file for complete search history.

(56) References Cited

U.S. PATENT DOCUMENTS 2,907,977 A * 10/1959 Daley ..... 439/798
3,668,591 A * 6/1972 Kobryner ..... 439/724
5,244,423 A * 9/1993 Erickson et al. ..... 439/798
6,612,879 B1 * 9/2003 Zahnen ..... 439/798
7,134,921 B2 * 11/2006 Siracki et al. ..... 439/798
7,175,484 B1 * 2/2007 Tamm et al. ..... 439/798
7,311,564 B2 * 12/2007 Zahnen ..... 439/798

* cited by examiner

*Primary Examiner*—Khiem Nguyen
(74) *Attorney, Agent, or Firm*—Thomas R. Vigil

(57) ABSTRACT

The present invention relates to a power supply terminal of connecting devices of electrical conduction that includes an insulating terminal block. An earth wire connecting block, zero wire connecting block and two live wire connecting blocks are juxtaposed in said terminal block. Said earth wire connecting block, zero wire connecting block and two live wire connecting blocks respectively have the corresponding wiring input terminal and wiring output terminal. It is characterized in that said terminal block also includes a switch module with wiring input terminal and wiring output terminal, corresponding connections and conductions between said wiring input terminal, said wiring output terminal and said live wire connecting blocks can be carried out through the connectors; switch module is arranged between two live wire connecting blocks and is adjacent to two live wire connecting blocks; switch module includes a input sub-connecting block and two output sub-connecting blocks, wherein said input sub-connecting block set up wiring input terminal and switch end; said output sub-connecting blocks respectively set up wiring output terminal and switch end; said two live wire connecting blocks respectively set up switch end; said connector is connected between said switch end. The present invention has strong adaptability.

9 Claims, 6 Drawing Sheets

POWER SUPPLY TERMINAL

BACKGROUND OF THE INVENTION

The present invention relates to connecting devices of electrical conduction, especially relating to a power supply terminal.

Existing power supply terminals are often directed at specific power supply mode, on the market the same machine may need to apply to single-phase, two-phase or three-phase power supply, etc., in different occasions, location (or countries), even if all the internal structures of this kind of machine are the same, the different power supply modes lead to the variety of power connection, which need the professional to connect power wiring according to the variety, this will cause many unnecessary troubles, sometimes, even needing re-designed machines' style because of the variety of power connection, and therefore, existing power supply terminal has poor adaptability.

SUMMARY OF THE INVENTION

The purpose of this invention is to provide a power supply terminal with strong adaptability, and to solve the problems that in the existing technology power supply terminals have poor adaptability because the different power modes lead to the variety of power connection.

A power supply terminal used in the invention includes the insulating terminal block, earth wire connecting block, zero wire connecting block and two live wire connecting blocks are juxtaposed in said terminal block, said earth wire connecting block, zero wire connecting block and two live wire connecting blocks respectively have the corresponding wiring input terminal and wiring output terminal, it is characterized that said terminal block also includes a switch module with wiring input terminal and wiring output terminal, corresponding connections and conductions between said wiring input terminal, said wiring output terminal and said live wire connecting blocks can be carried out through the connectors.

Said switch module is arranged between two live wire connecting blocks and is adjacent to two live wire connecting blocks.

Said switch module includes an input sub-connecting block and two output sub-connecting blocks, wherein said input sub-connecting block sets up wiring input terminal and switch end; said output sub-connecting blocks respectively set up wiring output terminal and switch end; said two live wire connecting blocks respectively set up switch end; said connector is connected between said switch ends.

Said input sub-connecting block includes one wiring input terminal and two switch ends, said input sub-connecting block is placed horizontally, and perpendicular to the live wire connecting blocks, wiring input terminal is located between the two switch ends; said output sub-connecting block is placed vertically, and parallel to the live wire connecting block, wherein wiring output terminal is located outside the end.

Said output sub-connecting block and said switch end of the live wire connecting block are on the same horizontal line; switch ends of said two output sub-connecting blocks and two switch ends of said input sub-connecting block are correspondingly respectively in the corresponding vertical line.

Switch ends of said two output sub-connecting blocks and two switch ends of said input sub-connecting block are correspondingly connected with the respective connectors.

Switch ends of said two output sub-connecting blocks and switch ends of adjacent said live wire connecting block are respectively connected with the connectors.

Switch end of said input sub-connecting block, switch ends of two output sub-connecting blocks, and switch ends of live wire connecting block are connected with the connectors.

Said connector is an overall component with "π" type.

The beneficial effects of the present invention are: in the present invention, said terminal block includes a switch module with wiring input terminal and wiring output terminal, corresponding connections and conductions between said wiring input terminal, said wiring output terminal and said live wire connecting blocks can be carried out through the connectors, so that in the present invention connectors can be placed corresponding to power supply standard and accordingly the present invention has strong adaptability.

In the present invention, said switch module is arranged between two live wire connecting blocks and is adjacent to two live wire connecting blocks, so that connections of connectors can be facilitated and the practical applicability of the present invention can be enhanced.

In the present invention, said switch module includes an input sub-connecting block and two output sub-connecting blocks, wherein said input sub-connecting block set up wiring input terminal and switch end, said output sub-connecting blocks respectively sets up wiring output terminal and switch end, said two live wire connecting blocks respectively set up switch end, said connector is connected between said switch end, the setup of switch ends makes the present invention have simple structure and convenient operation.

Said input sub-connecting block includes one wiring input terminal and two switch ends, said input sub-connecting block is placed horizontally, and perpendicular to the live wire connecting blocks, wiring input terminal is located between the two switch ends; said output sub-connecting block is placed vertically, and parallel to the live wire connecting block, wherein wiring output terminal is located outside the end, such regular design of horizontal and vertical placement has user-friendly technology and low cost.

DETAILED DESCRIPTION OF THE PREFERRED EMBODIMENTS

Figure 1:
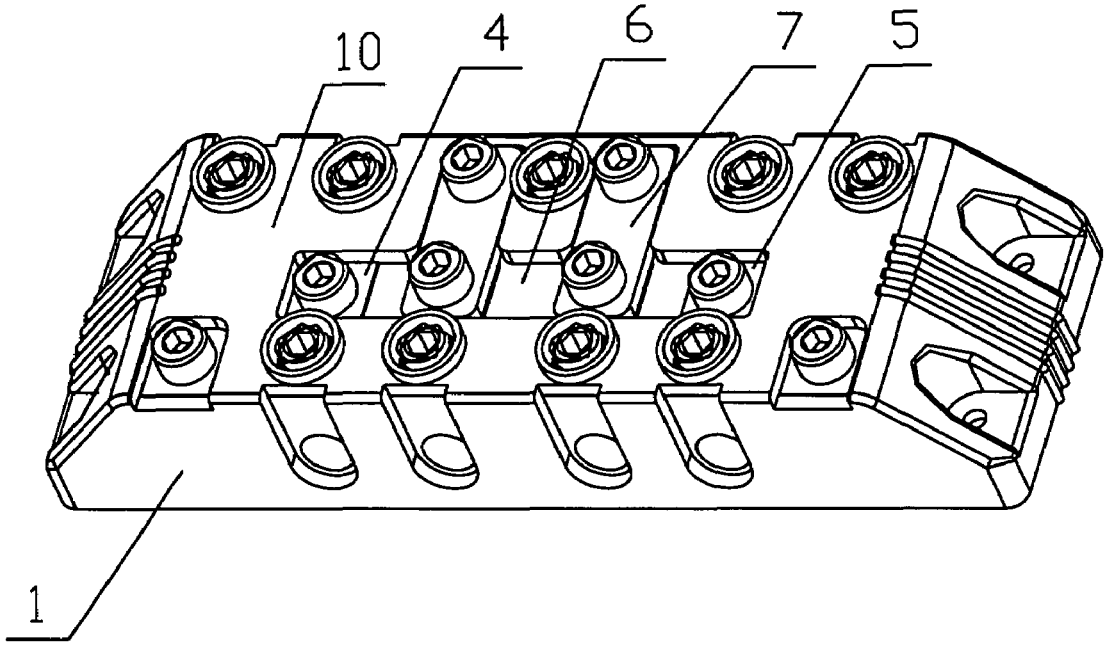
FIG. 1 is the schematic of the overall appearance of the power supply terminal.
Figure 2:
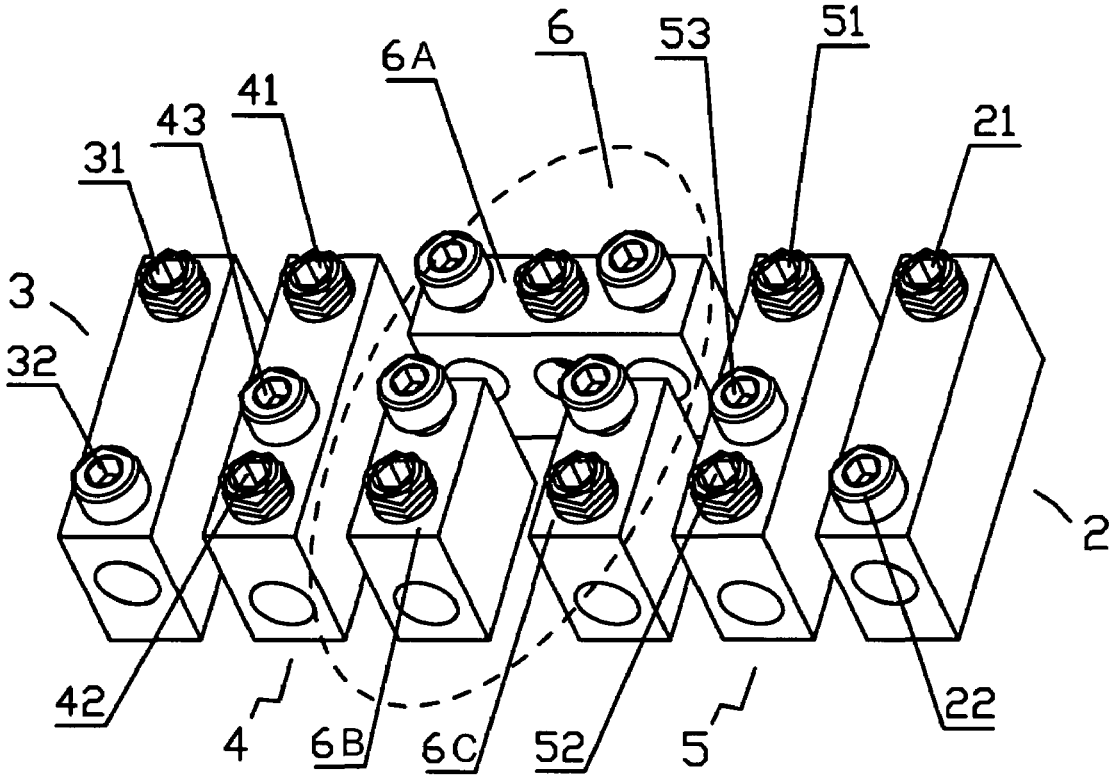
FIG. 2 is the schematic of the structure of each connecting block and switch module.
Figure 3:
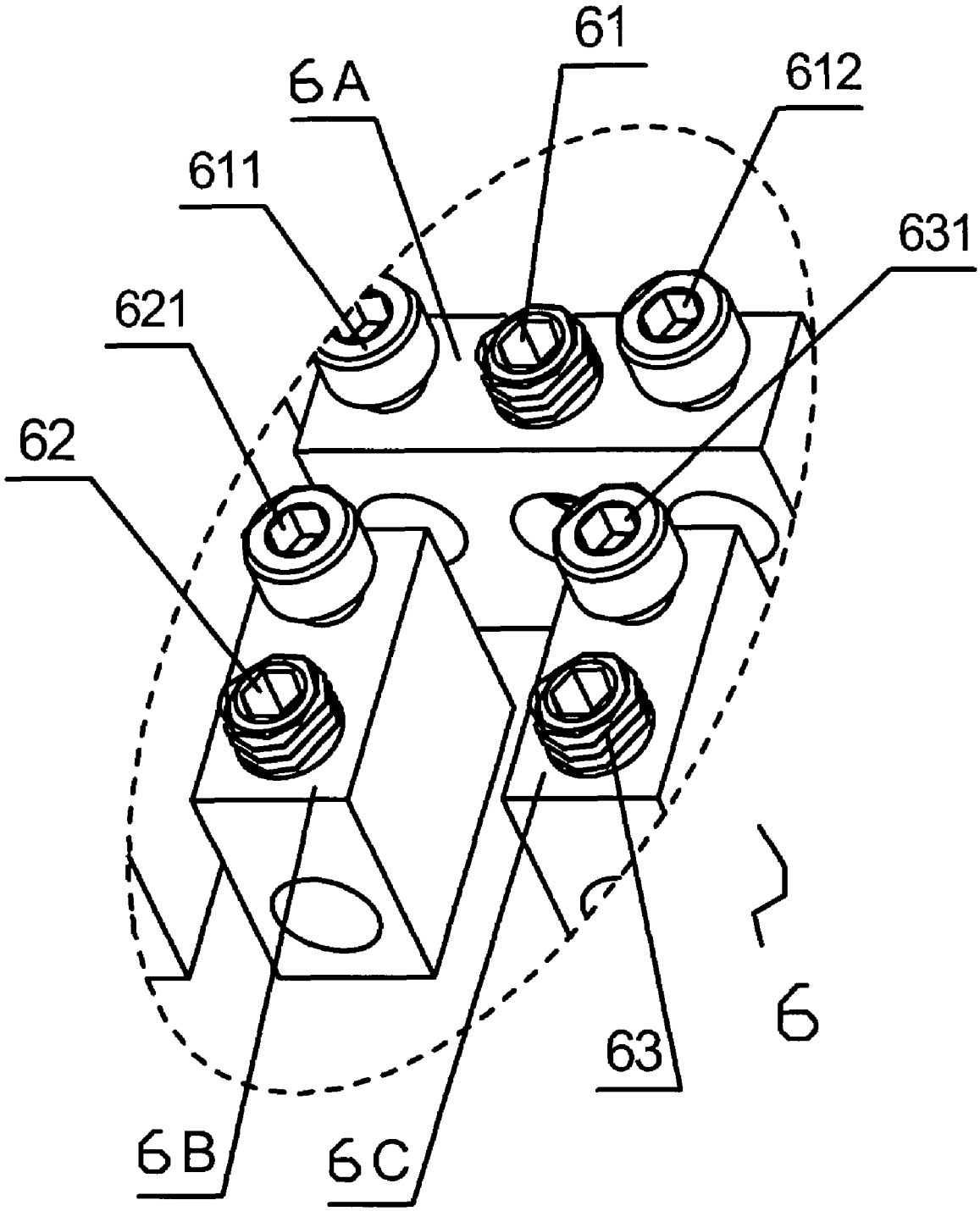
FIG. 3 is the schematic of the partial enlargement of switch module.
Figure 4:
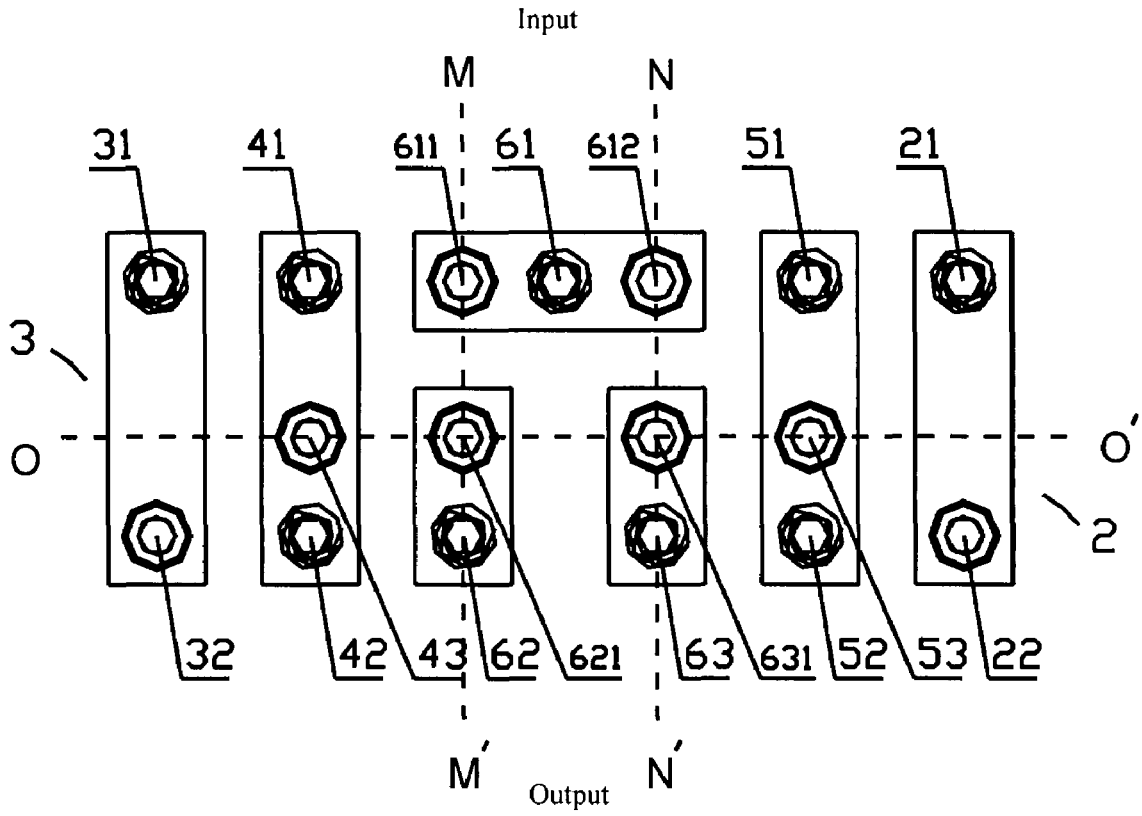
FIG. 4 is the schematic of the plane of each connecting block and switch module.

As follows there are further details about the present invention according to the attached drawings and embodiments:

According to FIG. 1, FIG. 2. FIG. 3 and FIG. 4, a power supply terminal includes the insulating terminal block 1, earth wire connecting block 2, zero wire connecting block 3 and two live wire connecting blocks 4,5 are juxtaposed in said terminal block 1, as shown in FIG. 2, said earth wire connecting block 2, zero wire connecting block 3 and two live wire connecting blocks 4,5 respectively have the corresponding wiring input terminal 21,31,41,51 and wiring output terminal 22,32,42,52.

As shown in FIG. 2, switch module 6 is arranged between two live wire connecting blocks 4,5 and is adjacent to two live wire connecting blocks 4,5. As shown in FIG. 2 and FIG. 3, switch module 6 includes an input sub-connecting block 6A and two output sub-connecting blocks 6B, 6C, the input sub-connecting block 6A includes one wiring input terminal 61 and two switch ends 611,612, as shown in FIG. 2 and FIG. 3, the input sub-connecting block 6A is placed horizontally, and perpendicular to the live wire connecting blocks 4,5, wiring input terminal 61 is located between the two switch ends 611,612.

As shown in FIG. 3, the output sub-connecting blocks 6B, 6C respectively set up wiring output terminal 62,63 and switch ends 621,631, as shown in FIG. 2 and FIG. 3, the output sub-connecting blocks 6B, 6C are placed vertically, and parallel to the live wire connecting blocks 4,5, wherein wiring output terminal 62,63 are located outside.

As shown in FIG. 2, the two live wire connecting blocks 4,5 respectively set up switch ends 43,53.

As shown in FIG. 4, the output sub-connecting blocks 6B, 6C and the switch ends 621,631,43,53 of the live wire connecting blocks 4,5 are on the same horizontal line OO'.

As shown in FIG. 4, the switch ends 621,631 of the two output sub-connecting blocks 6B, 6C and two switch ends 611,612 of the input sub-connecting block 6A are correspondingly respectively in the corresponding vertical line, that is, the switch end 621 and the switch end 611 are on the vertical line MM', the switch end 631 and the switch end 612 are on the vertical line NN'.

In the present invention, it is adopted the more commonly used screw design to the wiring input terminal 21,31,41,51,61 and the wiring input terminal 22,32,42,52,62,63, for the person skilled in the art, can execute a variety of structure of the wiring input terminals and the wiring output terminals without paying a creative work, which is not repeated here.

In the present invention, corresponding connections and conductions between the wiring input terminal 61, the wiring output terminals 62,63 and the live wire connecting blocks 4,5 can be carried out through the connectors 7, switch ends are connected through the connectors 7.

Figure 5:
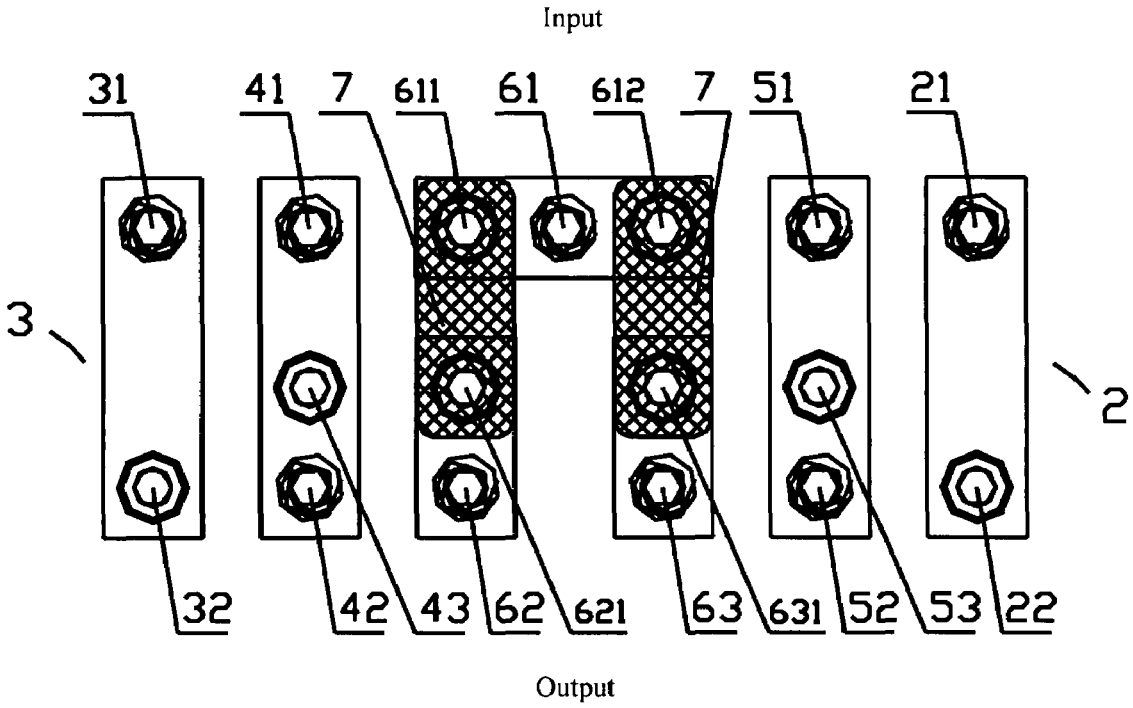
FIG. 5 is the schematic of the plane of each connecting block and switch module of three-phase power input modes.

In the present invention, the three main connecting ways are as followings:

1. Three-phase power input: As shown in FIG. 5, the switch ends 621,631 of the two output sub-connecting blocks 6B, 6C and two switch ends 611,612 of the input sub-connecting block 6A are correspondingly connected with the respective connectors 7, namely, the switch end 631 and the switch end 612 are connected by the connectors 7. Thus, the output sub-connecting block 6B and the output sub-connecting block 6C are assembled as single-phase model through connector 7, the output sub-connecting block 6B and the wiring output terminals 42,45 of the two live wire connecting blocks 4,5 are assembled as three-phase model. In the embodiment, the connector 7 can simply use (with through hole) sheet metal, the switch ends 611,612,621,631 have the structures of screw and bolt, pressing the sheet metal, for the person skilled in the art, can execute a variety of connections without paying a creative work, it will not be repeated here.

In the installation, as shown in FIG. 1, the terminal block 1 can be a type tank, in which the connecting blocks 2, 3, 4, 5 and switch module 6 are placed, covered with cover 10, with fasteners fixed, cover 10 has a notch which is convenient for installation of the connectors 7.

Figure 6:
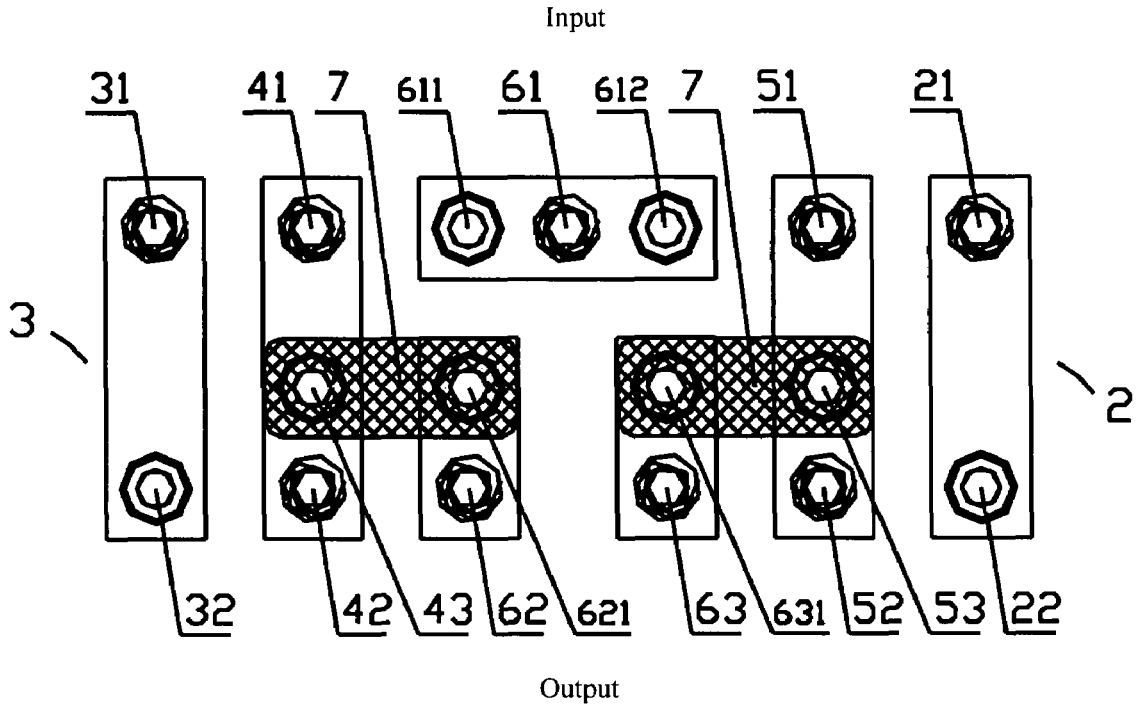
FIG. 6 is the schematic of the plane of each connecting block and switch module of two-phase power input modes.

2. Two-phase power input: As shown in FIG. 6, the switch ends 621,631 of the two output sub-connecting blocks 6B, 6C are connected the switch ends 43,53 of the live wire connecting blocks 4,5 through the connectors 7, namely, the switch ends 621 is connected with the switch ends 43 through the connectors 7, the switch ends 631 is connected with the switch ends 53 through the connectors 7. Thus, the output sub-connecting block 6B and the live wire connecting block 4 are assembled as single-phase model, the output sub-connecting block 6C and the live wire connecting block 5 are assembled as single-phase model.

Figure 7:
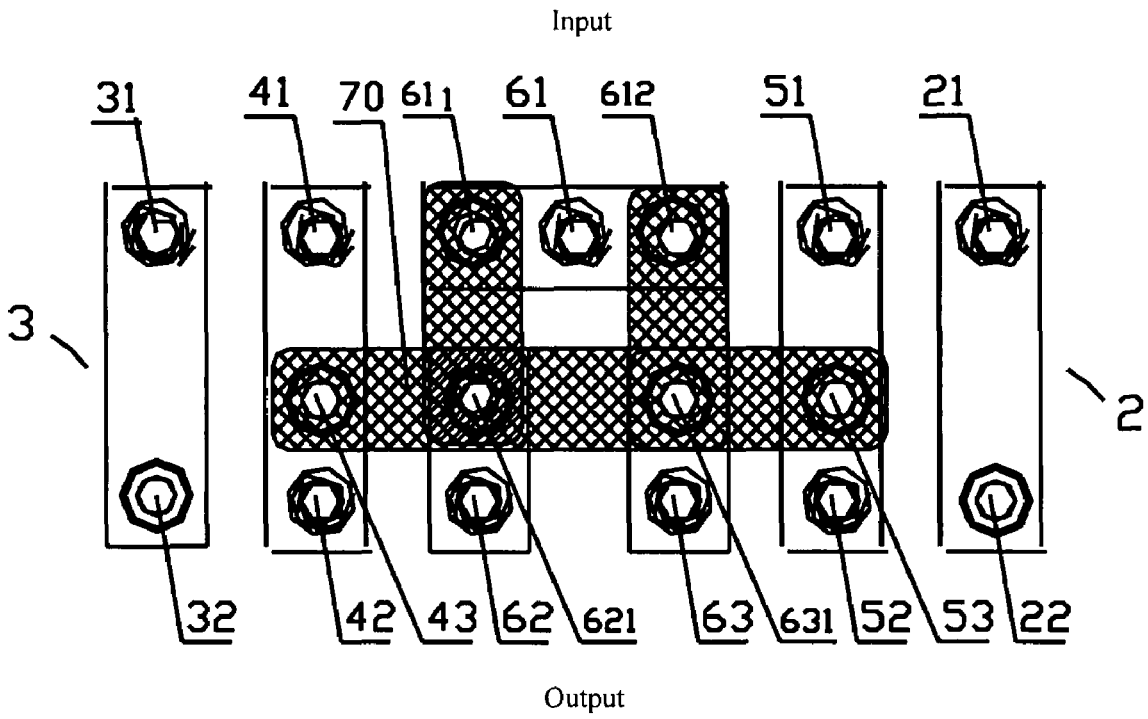
FIG. 7 is schematic of the plane of each connecting block and switch module of single-phase power input modes.

3. Single-phase power input: As shown in FIG. 7, the switch ends 611,612,621,631,43,53 of the input sub-connecting block 6A, the two output sub-connecting blocks 6B, 6C and the two live wire connecting blocks 4,5 are connected through connector 70, for the convenience of connectivity, connector 70 is a whole component with "π" type, of course, it can also use said connector 7, through which the switch ends 611,612,621,631,43,53 are connected with each other. Thus, the input sub-connecting block 6A, the two output sub-connecting blocks 6B, 6C and the two live wire connecting blocks 4,5 are assembled as single-phase model.

In summary, though the basic structures and principles of the present invention are specifically addressed, on the premise of without deviating from the gist of the present invention, according to the above-mentioned inspiration, for the person skilled in the art, can execute a variety of transformations/replacements or combinations without paying a creative work, which will be not repeated here.

What is claimed is:

1. A power supply terminal comprising an insulating terminal block, wherein an earth wire connecting block, a zero wire connecting block and two live wire connecting blocks are juxtaposed in said terminal block, and said earth wire connecting block, zero wire connecting block and two live wire connecting blocks have the corresponding wiring input terminal and wiring output terminal, respectively, which is characterized in that said terminal block further comprises a switch module with wiring input terminal and wiring output terminal, and the corresponding connections and conductions between said wiring input terminal, said wiring output terminal and said live wire connecting blocks can be carried out through the connectors.

2. A power supply terminal as defined in claim 1, wherein said switch module is arranged between two live wire connecting blocks and is adjacent to two live wire connecting blocks.

3. A power supply terminal as defined in claim 1, wherein said switch module includes an input sub-connecting block and two output sub-connecting blocks, wherein said input sub-connecting block sets up wiring input terminal and switch end; said output sub-connecting blocks respectively set up wiring output terminal and switch end; said two live wire connecting blocks respectively set up switch ends; and said connector is connected between said switch ends.

4. A power supply terminal as defined in claim 3, wherein said input sub-connecting block includes one wiring input terminal and two switch ends, said input sub-connecting block is placed horizontally, and perpendicular to the live wire connecting blocks, wiring input terminal is located between the two switch ends; said output sub-connecting block is placed vertically, and parallel to the live wire connecting block, wherein wiring output terminal is located outside the switch ends.

5. A power supply terminal as defined in claim 4, wherein said output sub-connecting block and said switch end of the live wire connecting block are on the same horizontal line; switch ends of said two output sub-connecting blocks and two switch ends of said input sub-connecting block are correspondingly respectively in the corresponding vertical line.

6. A power supply terminal as defined in claim 4, wherein switch ends of said two output sub-connecting blocks and two switch ends of said input sub-connecting block are correspondingly connected with the respective connectors.

7. A power supply terminal as defined in claim 4, wherein switch ends of said two output sub-connecting blocks and switch ends of adjacent said live wire connecting block are respectively connected with the connectors.

8. A power supply terminal as defined in claim 4, wherein switch end of said input sub-connecting block, switch ends of two output sub-connecting blocks, and switch ends of live wire connecting block are connected with the connectors.

9. A power supply terminal as defined in claim 4, wherein said connector is an overall components with "π" type.

* * * * *